US006249922B1

(12) United States Patent
Shimizu

(10) Patent No.: US 6,249,922 B1
(45) **Date of Patent: *Jun. 26, 2001**

(54) AUTOMATIC HAIR WASHER

(75) Inventor: Hirohisa Shimizu, Osaka (JP)

(73) Assignee: Oohiro Works, Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/378,185

(22) Filed: Aug. 20, 1999

(30) Foreign Application Priority Data

Nov. 27, 1998 (JP) ..... 10-337915

(51) Int. Cl.[7] ..... A45D 19/00
(52) U.S. Cl. ..... 4/515; 4/518; 4/601
(58) Field of Search ..... 4/515, 516, 517, 4/518, 519, 598, 602, 601, 618, 603, 597, 605; 417/317, 318

(56) References Cited

U.S. PATENT DOCUMENTS 3,521,647 * 7/1970 Mercer ..... 4/518
4,867,189 * 9/1989 Moineau ..... 4/605
5,121,511 * 6/1992 Sakamoto et al. ..... 4/601
5,414,879 * 5/1995 Hiraishi et al. ..... 4/601

FOREIGN PATENT DOCUMENTS 2-134121 5/1990 (JP) .
WO 94/05179 * 3/1994 (JP) ..... 4/519

* cited by examiner

*Primary Examiner*—Steven O. Douglas
*Assistant Examiner*—Khoa Huynh
(74) *Attorney, Agent, or Firm*—Burr & Brown

(57) ABSTRACT

An automatic hair washer having a basin with a plurality of washing nozzles for spouting wash water into the basin, a hot water storing tank for storing wash water, a pump for pumping out wash water from the hot water storing tank to the washing nozzles, electromagnetic valves for controlling spouting of the wash water from the washing nozzles, electromagnetic valve control means for controlling the electromagnetic valves so that wash water flows from at least one of the washing nozzles during a predetermined period and, by opening the electromagnetic valve of another of the washing nozzles while wash water flows from the at least one washing nozzle, wash water flows from both washing nozzles in an overlapping manner. A pump control means is also included for controlling the pump so as to decrease the hydraulic pressure of wash water supplied to the at least one washing nozzle just before opening the electromagnetic valve of another washing nozzle and to gradually increase the hydraulic pressure of wash water supplied to another washing nozzle to be a predetermined hydraulic pressure at the same time that the electromagnetic valve of the another washing nozzle is opened.

2 Claims, 5 Drawing Sheets

AUTOMATIC HAIR WASHER

FIELD OF THE INVENTION

The present invention relates to an automatic hair washer which is established in a beauty salon, a barber's shop or the like and automatically washes a person's hair.

BACKGROUND OF THE INVENTION

FIG. 3 is a diagram illustrating a construction of a prior art automatic hair washer.

In the figure, reference numeral 1 designates a mixing tank for mixing water and hot water, which is delivered from an external water supply and an external hot water supply via a curb stop, a strainer, and a check valve (which are not shown) and preparing wash water having a temperature suitable for hair washing. Numeral 2 designates a motor valve. Numeral 3 designates a hot water storing tank for storing the wash water supplied from the mixing tank 1 via the motor valve 2. Numeral 4 designates a thermistor provided at a lower position of the hot water storing tank 3 to measure a temperature of the wash water in the hot water storing tank 3. Numeral 5 designates a float switch for detecting an amount of the wash water in the hot water storing tank 3. Numeral 6 designates a hot water supplying pump for pumping out the wash water from the hot water storing tank 3. Numeral 7 designates a valve for hand shower. Numeral 8 designates a drawable hand shower used for washing off hairs, shampoo agent, or rinse agent which are attached to a cistern, or in finishing hair washing. Character $A_1$ designates a hot water supply pipe, one end of which is connected to the hot water supplying pump 6 to lead the wash water pumped out by the hot water supplying pump 6. Numeral 9 designates a drainage electromagnetic valve provided in midway of the hot water supply pipe $A_1$ to drain unnecessary wash water. Numerals 10*a* to 10*k* designate hot water supplying electromagnetic valves. Characters $SV_1$ to $SV_{11}$ designate shower heads, each being connected to an end of the branched hot water supply pipe $A_1$ to spout the wash water. Numeral 11 designates a shampoo tank for storing shampoo agent. Numeral 12 designates a rinse tank for storing rinse agent. Numeral 13 designates a shampoo supplying pump for pumping out the shampoo agent from the shampoo tank 11. Numeral 14 designates a rinse supplying pump for pumping out the rinse agent from the rinse tank 12. Numerals 15 and 16 designate check valves. Numerals 17*a* to 17*f* designate nozzle heads, each being connected to an end of the branched hot water supply pipe $A_1$ to spout the wash water mixed with the shampoo agent or the rinse agent which is pumped from the shampoo tank 11 or the rinse tank 12. Numeral 28 designates a hot water supplying electromagnetic valve control unit for controlling opening and closing operation of the hot water supplying electromagnetic valves 10*a* to 10*k*.

FIG. 4 is a longitudinal sectional view illustrating a cistern in the prior art automatic hair washer.

In the figure, the same reference numerals and characters as those in FIG. 3 designate the same or corresponding parts. Character B designates a cistern. A person whose hair is to be washed lies on his back and inserts his head into this cistern B to have his hair washed. As shown in the figure, a plurality of washing nozzles are provided inside the cistern B, and the wash water is spouted from these washing nozzles and reaches to the head of the person.

Hereinafter, operation of the prior art automatic hair washer will be described.

First, in an initial operation, hot water and cold water is given to the mixing tank 1 from an external water supply and an external hot water supply via a curb stop, a strainer, and a check valve. The hot water and the cold water is mixed in the mixing tank 1 to be warm water having a temperature suitable for hair washing, and supplied to the hot water storing tank 3 via the motor valve 2. The wash water stored in the hot water storing tank 3 is sucked by the hot water supplying pump 6 and supplied to the hot water supply pipe $A_1$.

Next, the hot water supplying electromagnetic valve 10*a* is opened by the hot water supplying electromagnetic valve control unit 28 and the wash water is spouted from the shower heads $SV_1$. After the wash water flows during a predetermined period, the hot water supplying electromagnetic valve 10*a* is closed.

Then the hot water supplying electromagnetic valve 10*e* is opened and the wash water is spouted from the shower head $SV_2$. Thereafter, as shown in FIG. 5, the wash water is spouted from the shower heads $SV_3$ to $SV_{11}$ by turns with a time interval.

When the spouting of the wash water from the shower heads $SV_1$, to $SV_{11}$ ends, the subsequent process, i.e., shampooing process is started. The shampoo agent pumped out by the shampoo supplying pump 13 is spouted from the nozzle heads 17*a* to 17*f* together with the wash water. When the shampooing process ends, the subsequent rinsing process and the process for washing with clean water follow, and a series of washing processes ends.

In using the above-described prior art automatic hair washer, there is a time interval after the wash water is spouted from a washing nozzle and before spouting from the following washing nozzle. Therefore the wash water is intermittently spouted to the head of the person. As a result, while the wash water is not spouted, the person under hair washing may feel anxious about whether the automatic hair washer might have stopped or from which direction the wash water will be spouted next.

In addition, if the wash water is forcibly spouted from the washing nozzles, the person may be surprised with the wash water being unexpectedly spouted over the head.

SUMMARY OF THE INVENTION

To solve the above problems, it is an object of the present invention to provide an automatic hair washer which enables adjustment of the timing of spouting of the wash water or the hydraulic pressure of the wash water flowing from the washing nozzles.

Other objects and advantages of the present invention will become apparent from the detailed description and specific embodiments described are provided only for illustration since various additions and modifications within the spirit and scope of the invention will be apparent to those of skill in the art from the detailed description.

According to a first aspect of the present invention, an automatic hair washer having a plurality of washing nozzles for spouting wash water pumped out from a hot water storing tank for storing the wash water to hair comprises a pump for pumping out the wash water from the hot water storing tank, an electromagnetic valve for controlling spouting of the wash water from the washing nozzles, an electromagnetic valve control means for controlling the electromagnetic valve so that the wash water flows from part of the washing nozzles during a predetermined period and, by opening the electromagnetic valve of another set of washing nozzles while the wash water flows out from the first set of washing nozzles, the wash water flowing out from the washing nozzles overlaps, and a pump control means for controlling the pump to decrease the hydraulic pressure of the wash water supplied to the first set of washing nozzles just before opening the electromagnetic valve of the second set of washing nozzles, and to gradually increase the hydraulic pressure of the wash water supplied to the washing nozzles to be a predetermined hydraulic pressure at the same time that the electromagnetic valves of the second set of washing nozzles are opened. Therefore, the wash water is spouted from the washing nozzles continuously and the power of the wash water flowing from the washing nozzles is weak at first and gradually gathers strength, whereby the person under hair washing does not become excessively nervous about timing or power of wash water splashing, and can have his hair washed more comfortably.

DETAILED DESCRIPTION OF THE PREFERRED EMBODIMENTS

Embodiment 1.

Figure 1:
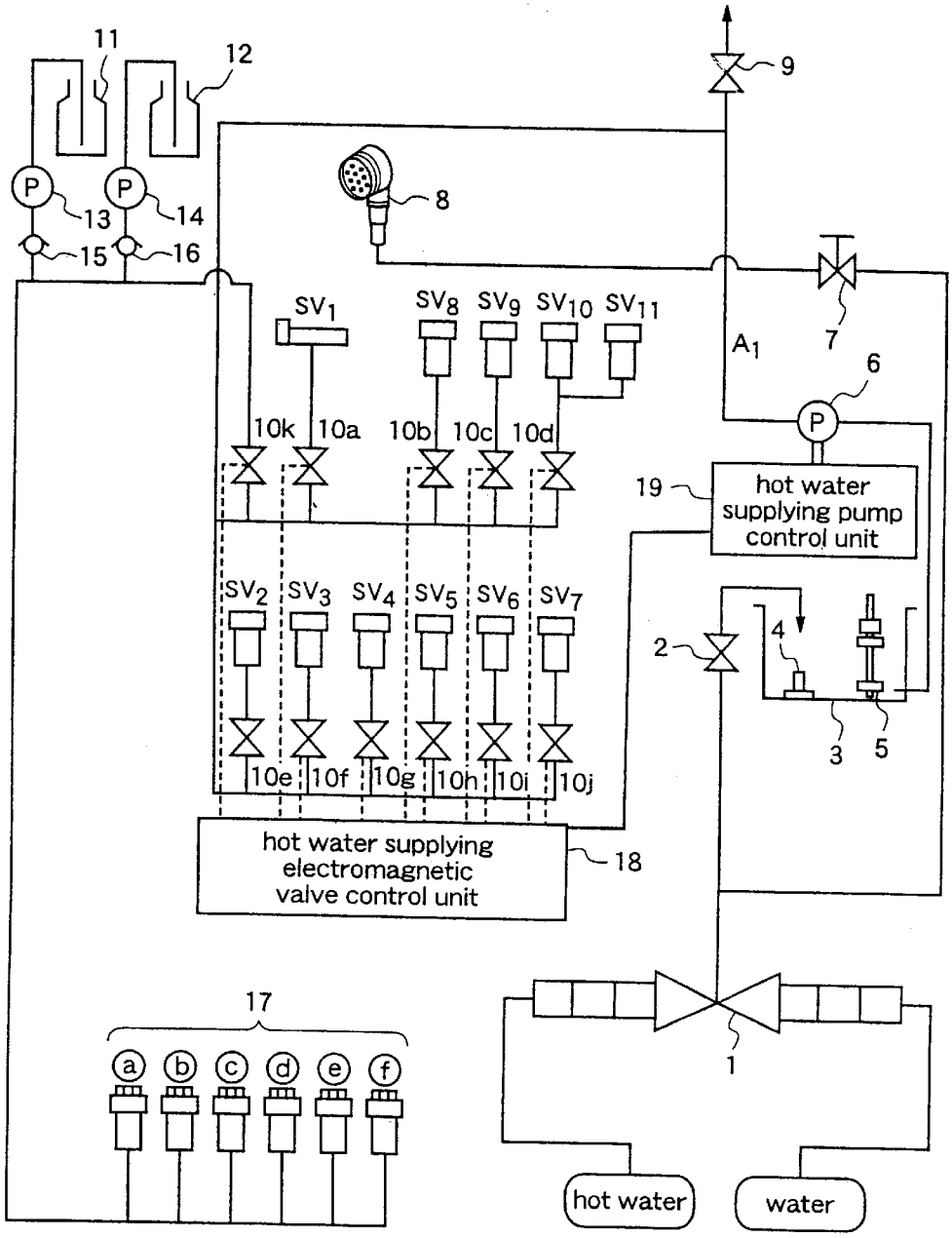
FIG. 1 is a diagram illustrating a construction of an automatic hair washer according to a first embodiment of the present invention.

FIG. 1 is a diagram illustrating a construction of an automatic hair washer according to a first embodiment of the present invention.

Figure 3:
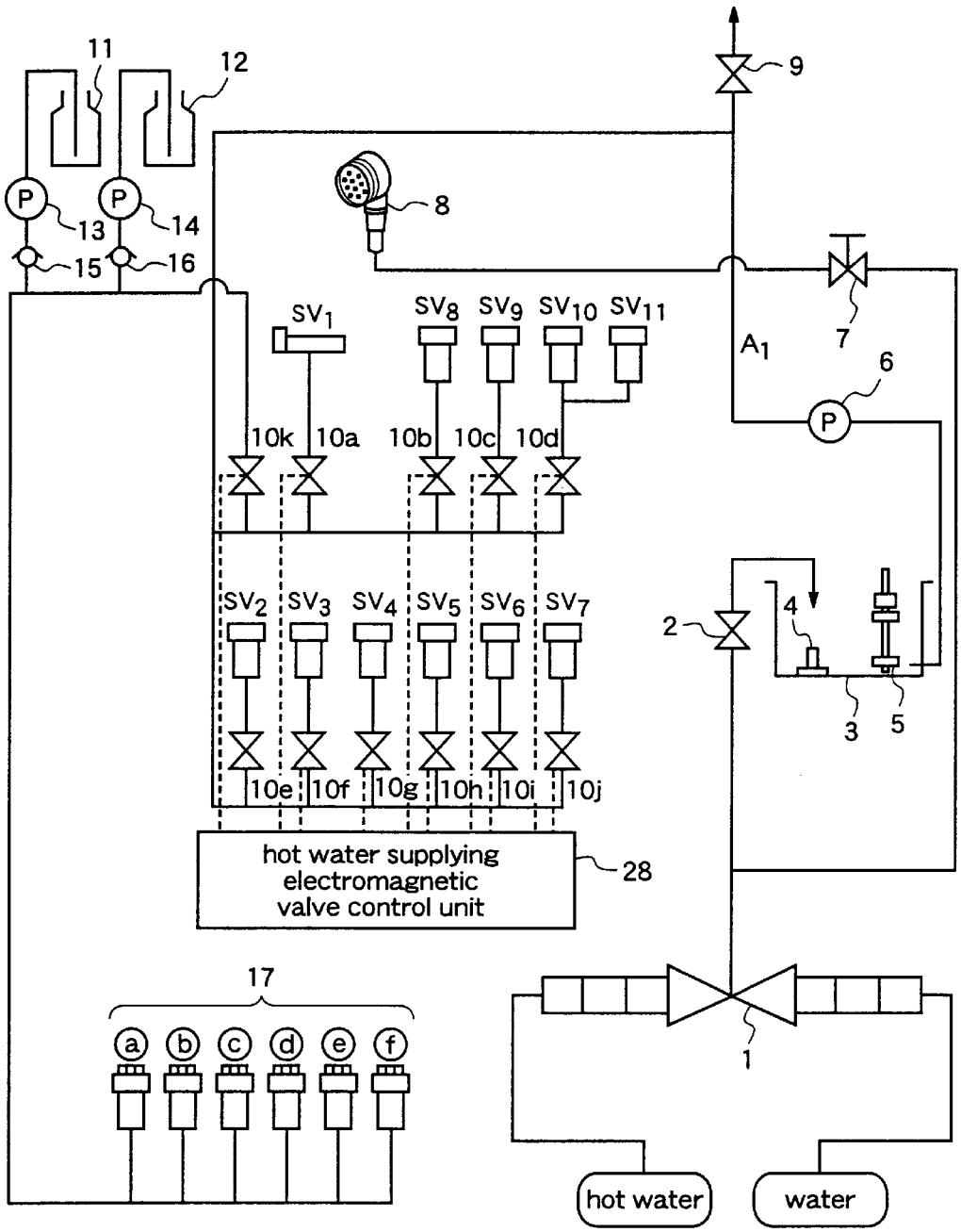
FIG. 3 is a diagram illustrating a construction of a prior art automatic hair washer.
Figure 4:
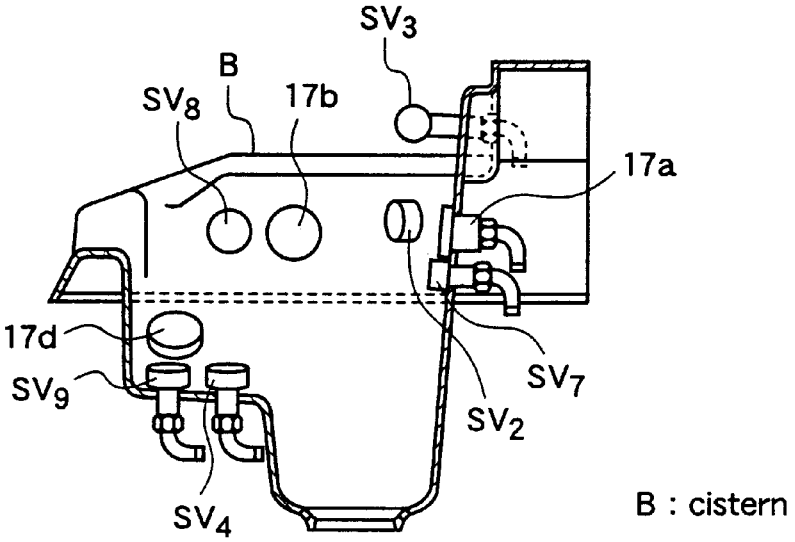
FIG. 4 is a longitudinal sectional view illustrating a cistern an the prior art automatic hair washers.
Figure 5:
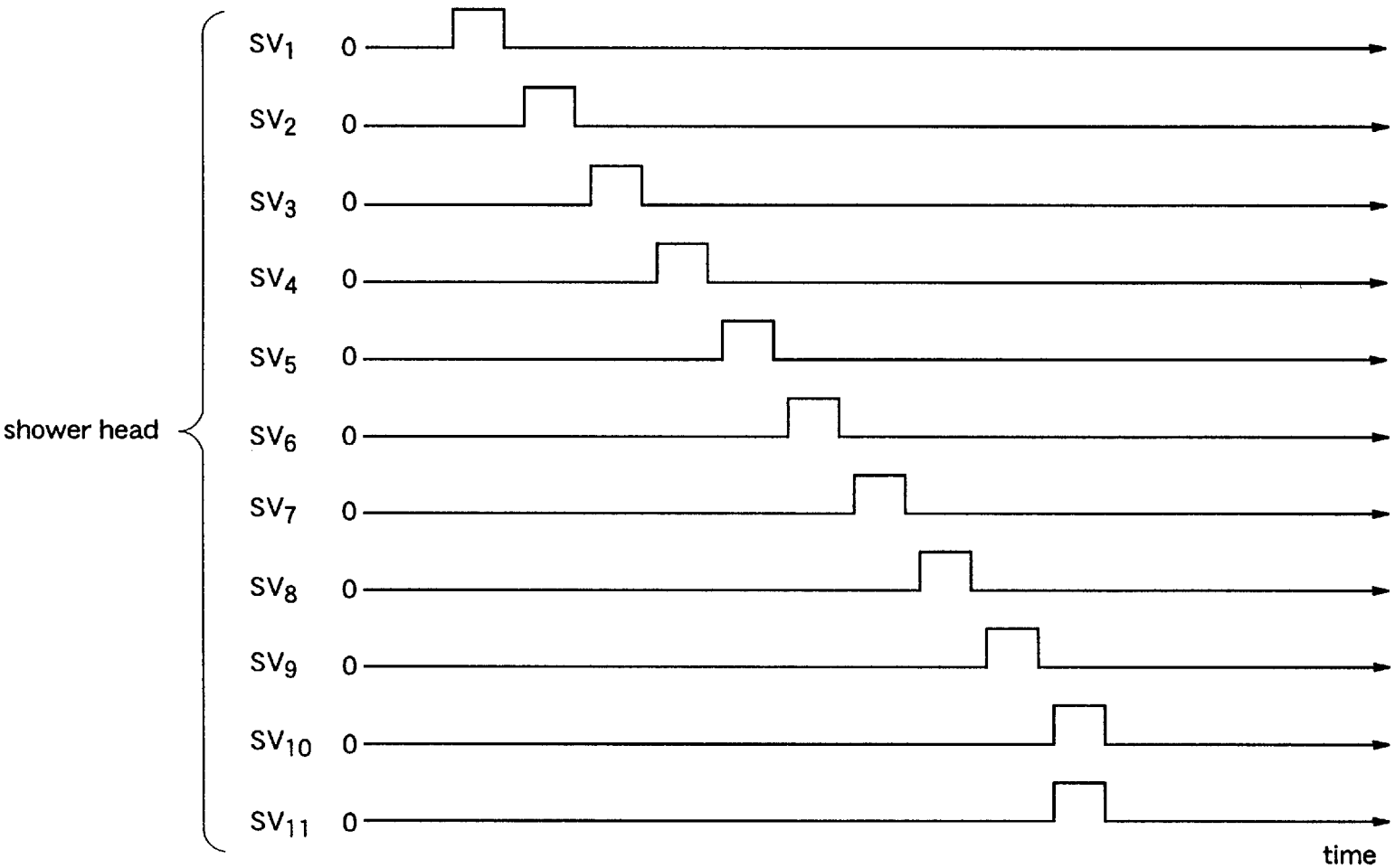
FIG. 5 is a timing chart showing an amount of wash water spouted from shower heads in the prior art automatic hair washer.

In the figure, the same reference numerals and characters as those in FIG. 3 designate the same or corresponding parts. Reference numeral 18 designates a hot water supplying electromagnetic valve control unit for controlling opening/closing operation of the hot water supplying electromagnetic valves 10*a* to 10*k*. Numeral 19 designates a hot water supplying pump control unit for controlling the hot water supplying pump 6 to vary hydraulic pressure of the wash water supplied to the hot water supply pipe $A_1$.

Hereinafter, operation of the automatic hair washer according to the first embodiment will be described.

First, in an initial operation, the wash water in the hot water storing tank 3 is sucked by the hot water supplying pump 6 and spouted from the shower heads $SV_1$ to $SV_{11}$ through the hot water supply pipe $A_1$ via the hot water supplying electromagnetic valves 10*a* to 10*k*.

Figure 2:
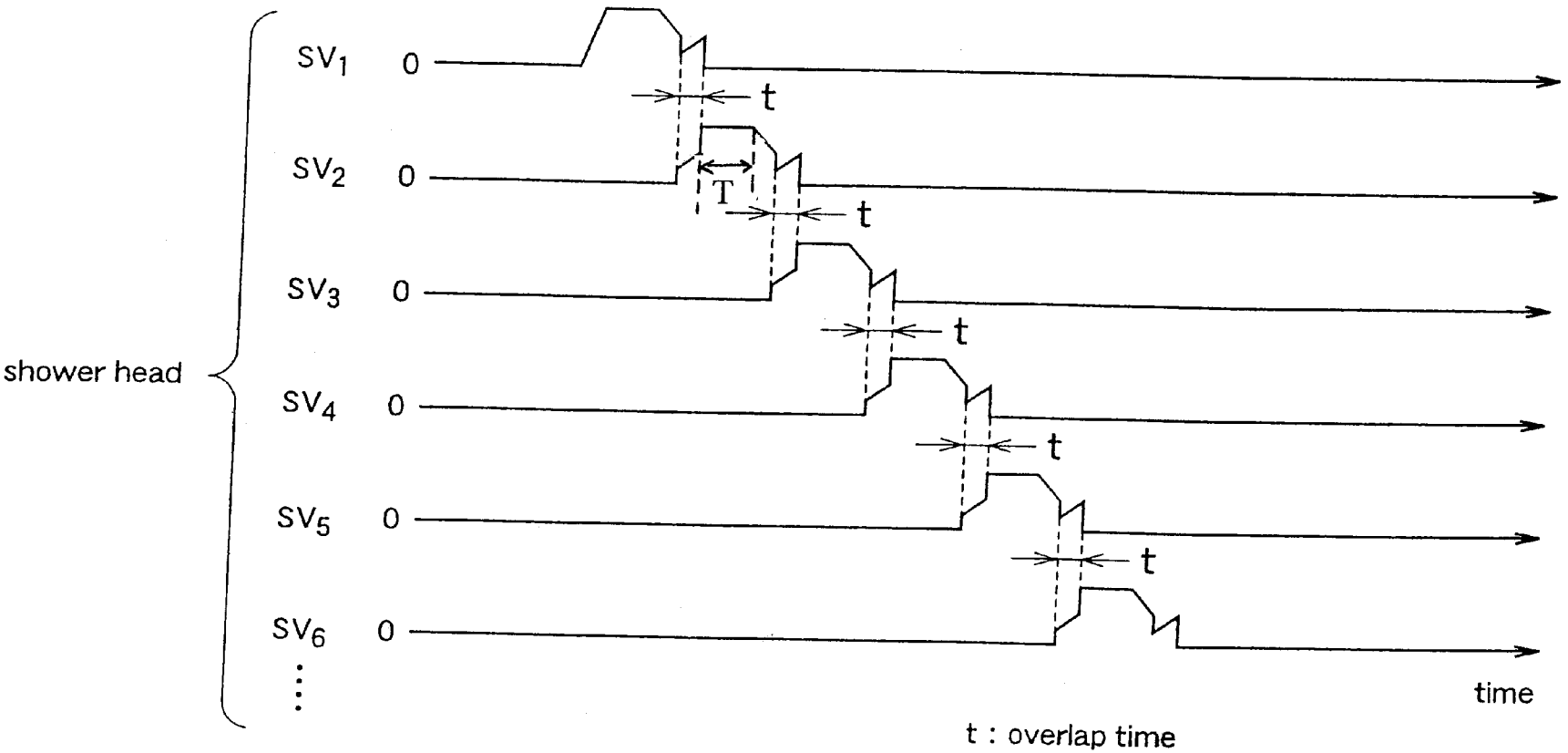
FIG. 2 is a timing chart showing an amount of wash water spouted from shower heads in the automatic hair washer of the first embodiment.

FIG. 2 is a timing chart showing an amount of the wash water spouted from shower heads $SV_1$ to $SV_{11}$.

As shown in the figure, the wash water is spouted from each of the shower heads $SV_1$ to $SV_{11}$ by turns during a predetermined period.

First, the hot water supplying electromagnetic valve 10*a* is opened by the hot water supplying electromagnetic valve control unit 18 and the wash water is spouted from the shower head $SV_1$. Then, before the end of spouting, the hot water supplying electromagnetic valve 10*b* is opened by the hot water supplying electromagnetic valve control unit 18 and the wash water flows out from the shower head $SV_2$. In this case, just before opening operation of the hot water supplying electromagnetic valve 10*b*, the hot water supplying pump control unit 19 decreases driving capacity of the hot water supplying pump 6 and decrease the hydraulic pressure of the wash water supplied to the washing nozzles. Then the hot water supplying electromagnetic valve 10*b* is opened at the same time that the driving capacity of the hot water supplying pump 6 is gradually increased so that the hydraulic pressure of the wash water becomes a predetermined hydraulic pressure. Thereby the wash water from the shower head $SV_2$ is not spouted initially, but gradually gathers the power and is in spouting condition later. Similarly, before closing operation of the hot water supplying electromagnetic valve 10, the hot water supplying electromagnetic valve 10 of the washing nozzles which is to spout next is opened. In this way, the wash water flowing out from the respective shower heads $SV_3$ to $SV_{11}$ by turns overlaps, the hydraulic pressure of the wash water supplied from the hot water supplying pump 6 to the washing nozzles is controlled by the hot water supplying pump control unit 19, and the hydraulic pressure of the wash water, which is temporarily decreased is gradually increased after opening the respective hot water supplying electromagnetic valves 10. Therefore, the wash water flowing out from the respective shower heads $SV_3$ to $SV_{11}$ is not abruptly spouted.

As described above, in the first embodiment, the period when the wash water is spouted from the respective shower heads $SV_1$ to $SV_{11}$ is overlapped by controlling the hot water supplying electromagnetic valves 10*a* to 10*k* by the hot water supplying electromagnetic valve control unit 18. Therefore, the person under hair washing does not feel anxious about whether the automatic hair washer breaks down or the like due to the wash water intermittently being spouted to the head, thereby providing more comfortable hair washing. In addition, the hydraulic pressure of the wash water supplied to the respective shower heads $SV_1$ to $SV_{11}$ is increased gradually to be the predetermined hydraulic pressure by controlling the hot water supplying pump 6 by the hot water supplying pump control unit 19. Therefore, the wash water is not abruptly spouted to the head of the person, thereby providing more comfortable hair washing.

What is claimed is:

1. An automatic hair washer comprising:

a basin;

a plurality of washing nozzles located within said basin for spouting wash water in said basin;

a hot water storing tank for storing wash water;

a pump for pumping wash water from the hot water storing tank to the washing nozzles;

electromagnetic valves for controlling spouting of the wash water from said washing nozzles, said electromagnetic valves corresponding to each of said washing nozzles;

electromagnetic valve control means for controlling the electromagnetic valves so that wash water flows from at least one nozzle of said washing nozzles during a predetermined period and, by opening the electromagnetic valve of a subsequent nozzle while wash water flows from said at least one washing nozzle, wash water flows from both nozzles of said washing nozzles in an overlapping manner; and pump control means for controlling said pump so as To gradually decrease the hydraulic pressure of wash water supplied to said at least one washing nozzle before opening the electromagnetic valve of said subsequent nozzle and to gradually increase the hydraulic pressure of wash water supplied to said both washing nozzles for a time period, t, wherein the time period, t, begins when the electromagnetic valve of said subsequent nozzle is opened and ends when the gradual increase in hydraulic pressure supplied to said both washing nozzles stops, and wherein a different time period, T, begins when said subsequent nozzle spouts wash water at a predetermined hydraulic pressure.

2. The automatic hair washer as recited in claim 1, wherein said time period, T, ends when the hydraulic pressure of wash water supplied to said subsequent nozzle decreases.

* * * * *